United States Patent [19]

Dumonceaux et al.

[11] Patent Number: 4,798,551

[45] Date of Patent: Jan. 17, 1989

[54] FLOATABLE BABY CARRIER

[76] Inventors: Gary W. Dumonceaux, R.R. #2, Box 57, Rochester, Ill. 62563; Edwin R. Weber, R.R. #1, Box 311, Pawnee, Ill. 62558; James D. Gibbs, 222 John St., Farmer City, Ill. 61842

[21] Appl. No.: 109,323

[22] Filed: Oct. 19, 1987

[51] Int. Cl.[4] ..... B63C 9/08

[52] U.S. Cl. ..... 441/130

[58] Field of Search ..... 441/38, 80, 86–89, 441/125–126, 129–130; 297/418, 445, 448, 454, 457

[56] References Cited

U.S. PATENT DOCUMENTS 3,620,570 11/1971 Wilson ..... 441/126

FOREIGN PATENT DOCUMENTS 101482 5/1925 Austria ..... 441/125

*Primary Examiner*—Joseph F. Peters, Jr.
*Assistant Examiner*—Jesûs D. Sotelo
*Attorney, Agent, or Firm*—Marshall, O'Toole, Gerstein, Murray & Bicknell

[57] ABSTRACT

A floatable carrier for a baby, comprising interior walls forming a baby receiving cavity, exterior walls fastened to the interior walls and forming a buoyancy space therebetween, said interior wall including a bottom wall, and a ballast secured to and extending downwardly from the bottom wall.

8 Claims, 1 Drawing Sheet

FLOATABLE BABY CARRIER

FIELD AND BACKGROUND OF THE INVENTION

This invention relates to baby carriers, and more particularly to a floatable baby carrier for use around water, such as near pools or on docks and boats.

There are, of course, numerous designs of baby carriers available on the market and described in various publications. Such carriers are designed to support a baby which is placed on its back in the carrier with its legs bent at the hips, similar to the posture of a person sitting in a reclining chair. Often the carrier is adjustable so that the baby's back is horizontal or at an upwardly inclined position.

Some carriers are designed to be lightweight and easily portable so that the mother may carry the baby into a supermarket, etc. and place the carrier in a shopping cart. Other carriers are designed for use primarily in cars and may be secured on a car seat by a belt in the car. There remains a need for a baby carrier for use primarily around water, such as on leisure boats for families.

It is therefore a general object of this invention to provide an improved baby carrier designed for use primarily near water.

SUMMARY OF THE INVENTION

A baby carrier in accordance with this invention comprises an interior wall and an exterior wall. The interior wall is shaped to form a back support part, a rump support part, a leg support part and sides parts, these parts forming a baby receiving cavity. The exterior wall is spaced outwardly from the interior wall and a buoyant material is located in the interior space between the two walls and around the cavity. Extending below and downwardly from the cavity is mounted a ballast. The ballast lowers the center of gravity and, combined with the buoyant material, causes the carrier to float in water with the cavity facing upwardly and the baby's head above the water level, regardless of the orientation of the carrier when it is initially placed in the water.

BRIEF DESCRIPTION OF THE DRAWINGS

The invention will be better understood from the following detailed description taken in conjunction with the accompanying figures of the drawings, wherein.

DETAILED DESCRIPTION OF THE DRAWINGS

Figure 1:
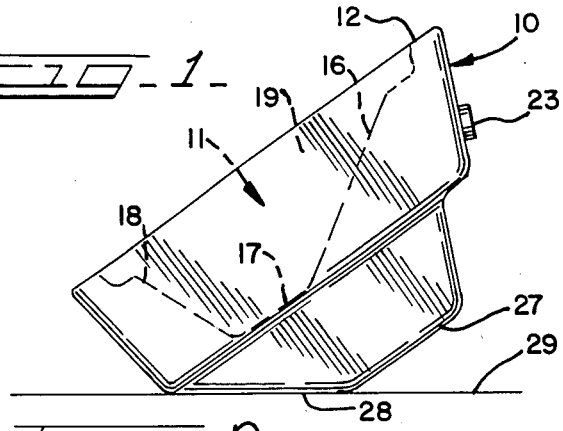
FIG. 1 is a side elevational view of a carrier in accordance with the present invention.

A baby carrier in accordance with the present invention includes a plurality of walls which are made of a durable relatively hard material such as molded rigid plastic. The walls include an exterior wall 10 and an interior wall 11 which are generally spaced apart but rigidly connected together. The walls 10 and 11 are connected along the upper surface in the area indicated by the numeral 12 and by a generally flat interior partition 13.

The interior wall 11 includes a back support part 16, a rump support part 17, a leg support part 18 and side parts 19 which are integrally formed. The wall parts 16, 17 and 18 are shaped to form a baby receiving cavity or opening which cradles a baby placed on its backside against the wall parts 16, 17 and 18, and the side wall parts 19, of course, prevent the baby from rolling sideways out of the cavity.

Figure 4:
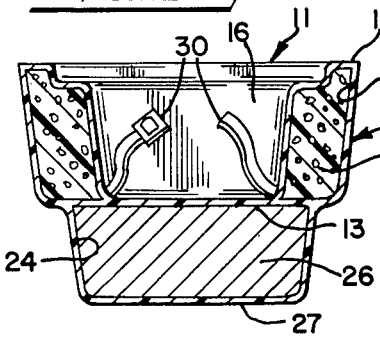
FIG. 4 is a sectional view taken on the line 4—4 of FIG. 2.
Figure 5:
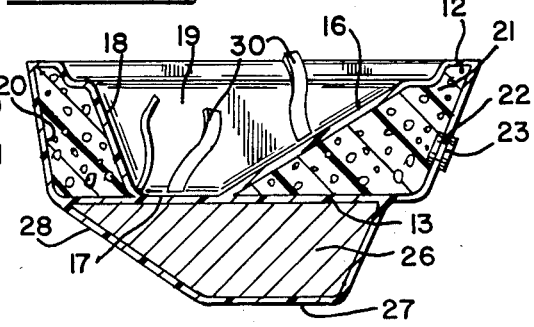
FIG. 5 is a sectional view taken on the line 5—5 of FIG. 3.

The upper portion of the exterior wall 10 is spaced from the wall parts 16 through 19 to form an opening 20 which receives a buoyant material 21 such as Styrofoam plastic. The opening between the interior and exterior walls extends entirely around the baby receiving cavity, as shown in FIGS. 4 and 5. There is an increased amount of the buoyant material at the head end of the carrier, underneath the back support part 16 of the interior wall, as shown in FIG. 5. The buoyant material 21 may be inserted into the cavity after the interior and exterior walls have been molded and secured together, by forming an opening 22 in the exterior wall 10, extruding or injecting the buoyant material 21 into the opening and then sealing the opening 22 with a plug 23. Plastics are available for this purpose which may be injected in a flowable foam state and which set and become firm when in the opening 20.

With specific reference to FIGS. 4 and 5, the exterior wall 10 includes a lower portion which extends downwardly from and is spaced from the partition 13. The partition 13 is generally flat and extends across the underside of the baby receiving cavity and the opening 20, and the lower portion of the exterior wall 10 extends downwardly from the partition 13 as mentioned above and forms a ballast opening 24. Mounted within the opening 24 is a ballast material 26 which may be made, for example, of metal, sand, etc. The ballast material 26 is, of course, substantially heavier than the buoyant material 21 and lowers the center of gravity of the baby carrier to a point which is below the baby receiving cavity regardless of whether a baby is placed in the cavity.

Figure 2:
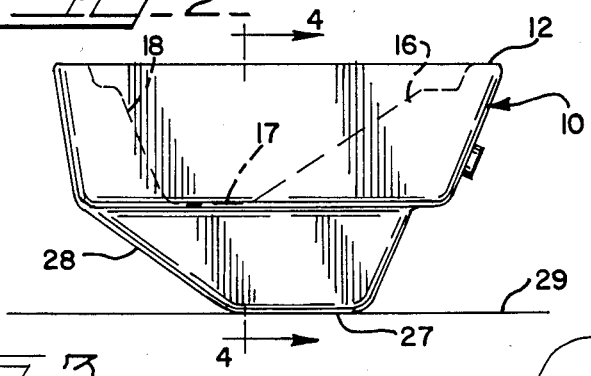
FIG. 2 is a view similar to FIG. 1 but shows the carrier in a different orientation.
Figure 3:
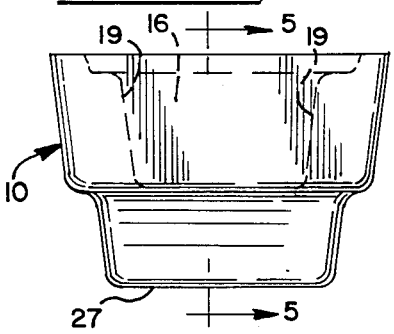
FIG. 3 is an end view of the carrier in the position shown in FIG. 2.

As best shown in FIGS. 1, 2 and 5, the lower portion of the exterior wall 10 includes a flat bottom part 27 which in this instance is generally parallel with the partition 13 and the uppermost surface of the carrier, and an inclined part 28 which slopes upwardly from the bottom part 27 toward the foot end of the carrier. When the carrier is placed on a supporting surface 29 (see FIG. 1) with the sloped part 28 on the surface 29, as shown in FIG. 1, the back part 16 of the interior wall slopes generally upwardly at a relatively steep angle so that the baby in the cavity is at nearly a sitting position. On the other hand, when the carrier is placed with the bottom part 27 on the surface 29 as shown in FIG. 2, the back support wall part 16 is slanted closer to the horizontal so that the baby is in a more reclining position. The weight 26, being heavier than baby and the remainder of the carrier, will hold the carrier in either of the two selected positions shown in FIGS. 1 and 2 despite activity of the baby within the carrier or rocking motion of a boat, thus adding stability to the carrier when it is placed on the supporting surface 29.

As a specific example of a carrier constructed in accordance with the present invention, the width of the carrier may be approximately 18½ inches between the outer sides of the exterior wall, the height of the carrier across its center may be approximately 15 inches, and the total length of the carrier may be approximately 30 inches. The weight of the ballast 26 may be approximately 40 pounds and the remainder of the carrier may be approximately 20 pounds, making a total weight of the carrier of approximately 60 pounds. The ballast 26 may be made of a relatively heavy material such as metal or sand. It should be understood, however, that the total weight of the carrier may vary with other construction techniques, and the above dimensions are given only as a specific example.

With reference to FIGS. 4 and 5, adjustable fastening belts 30 are preferably fastened to the interior wall 11 for the purpose of holding a baby in place within the cavity. The belts 30 preferably have clasps which may be readily opened or closed by an adult but not by a child. Further, while not shown, a soft cover is preferably provided over the interior surface of the inner wall 11 for the comfort of a baby.

Figure 6:
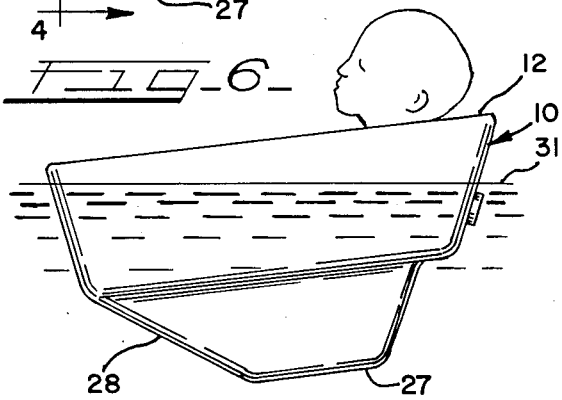
FIG. 6 is a view showing the carrier floating in the water.

As previously mentioned, the baby carrier is especially designed for ease of use near water such as on a boat, and when so used the carrier is placed on a deck or other convenient location on the boat and a baby is placed within the cavity and fastened using the belts 30. The carrier may be placed in either of the positions shown in FIGS. 1 and 2, and because of the relatively heavy ballast 26 and the flat bottom surfaces of the parts 27 and 28, the baby carrier is unlikely to tip over despite rocking movement of the boat. Further, in the event the carrier, with a baby in it, accidentally falls into the water, the center of gravity due to the relatively heavy ballast 26 is sufficiently low that the carrier will always turn to the position where the baby is facing upwardly, as shown in FIG. 6. The buoyancy of the material 21 is sufficient to overcome the ballast 26 so that, with a baby in the carrier, the baby carrier will nevertheless float despite the weight of the ballast 26. Further, the greater amount of the buoyancy material at the head end of the carrier and the height of the buoyancy material at the side wall parts 19 are sufficient that the baby's head projects above the side walls 19 and the level 31 of the water. Consequently, even if the cavity fills with water, if it has accidentally fallen into the water, the baby's head will not be within the water within the cavity.

It will be apparent from the foregoing that a novel and useful baby carrier has been provided. The carrier is shaped and has a sufficiently low center of gravity that it will not easily tip over in the event of rocking of a boat, and in the event the carrier with a baby in it falls into the water, the baby will be held safely upright. The carrier will float with the baby's head above both the water outside the carrier and any water in the cavity of the carrier. It is also an advantage that a greater amount of the buoyant material is located within the head end of the carrier so that the head of the baby will be lifted upright a slight amount to keep the baby's head above the water.

What is claimed is:

1. A floatable carrier for supporting a baby upright either in a body of water or on a generally flat support surface, comprising interior walls forming a baby receiving cavity, exterior walls fastened to said interior walls and forming a buoyancy space therebetween, a non-fluid buoyant material in said space, said interior walls including a bottom wall, belts secured to at least one of said walls for retaining a baby in said cavity, and a ballast made of solid material secured to and extending downwardly from said bottom wall.

2. A floatable carrier as set out in claim 1, wherein said buoyant material within said space is a foamed plastic.

3. A floatable carrier as set out in claim 1, wherein said ballast comprises a metal material and said exterior walls extend around and encloses said ballast.

4. A floatable carrier as set out in claim 1, wherein said exterior walls extend substantially entirely around said space.

5. A floatable carrier as set out in claim 4, wherein said carrier has a head end, and said buoyancy space is enlarged adjacent said head end.

6. A floatable carrier as set out in claim 1, wherein said exterior walls have a flat bottom side and an inclined side at an angle to said bottom surface for holding said carrier stable on a flat supporting surface at different angles.

7. A floatable carrier as set out in claim 2, wherein said buoyant material is secured to and extends laterally outwardly from said interior walls, and said ballast is secured to and extends downwardly from said bottom wall of said interior walls.

8. A floatable carrier as set out in claim 7, wherein said exterior walls are secured to said interior walls and extend around said ballast and said buoyant material.

* * * * *